United States Patent [19]

Larsson

[11] Patent Number: 4,701,589

[45] Date of Patent: Oct. 20, 1987

[54] METHOD AND APPARATUS FOR HEAT TREATING COILED SPRINGS

[75] Inventor: Jan S. Larsson, Spånga, Sweden

[73] Assignee: Tekno-Detaljer Lindstrom & Waerme AB, Järfälla, Sweden

[21] Appl. No.: 786,245

[22] Filed: Oct. 10, 1985

[30] Foreign Application Priority Data

Oct. 15, 1984 [SE] Sweden ..... 8405135

[51] Int. Cl.[4] ..... C21D 9/02

[52] U.S. Cl. ..... 219/50; 219/497

[58] Field of Search ..... 219/50, 110, 111, 115, 219/497

[56] References Cited

U.S. PATENT DOCUMENTS

| | | | |
|---|---|---|---|
| 2,105,105 | 8/1936 | Zimmerman | 219/50 |
| 3,391,331 | 7/1968 | French | 219/50 |
| 3,602,684 | 8/1971 | Friess | 219/110 |
| 3,935,413 | 1/1976 | Lesko et al. | 219/50 |

FOREIGN PATENT DOCUMENTS 292753 6/1966 Australia .

1253296 11/1967 Fed. Rep. of Germany .

*Primary Examiner*—Clifford C. Shaw

*Attorney, Agent, or Firm*—Fleit, Jacobson, Cohn & Price

[57] ABSTRACT

An apparatus for heat treating coiled springs comprises two electrodes (19,20), an electric current supply unit (10) for feeding a series of electric current pulses through a spring (21) placed between said electrodes (19,20), each of said pulses having the general shape of a portion of a sine half wave, an evaluation unit (11) for evaluating the amplitude of the sine half wave corresponding to each current pulse, and a control unit (12) for controlling the total energy supplied to the spring (21) from said current supply unit (10) in dependence upon said amplitude evaluation. In order to keep the total treatment time equal for all springs within a single series, the control unit (12) is arranged to bring the current supply unit (10) to feed a predetermined constant number of current pulses having low initial values through the spring (21) and to control the length of each current pulse in dependence upon the amplitude evaluation effected by the evaluation unit (11).

6 Claims, 3 Drawing Figures

METHOD AND APPARATUS FOR HEAT TREATING COILED SPRINGS

Figure 1:
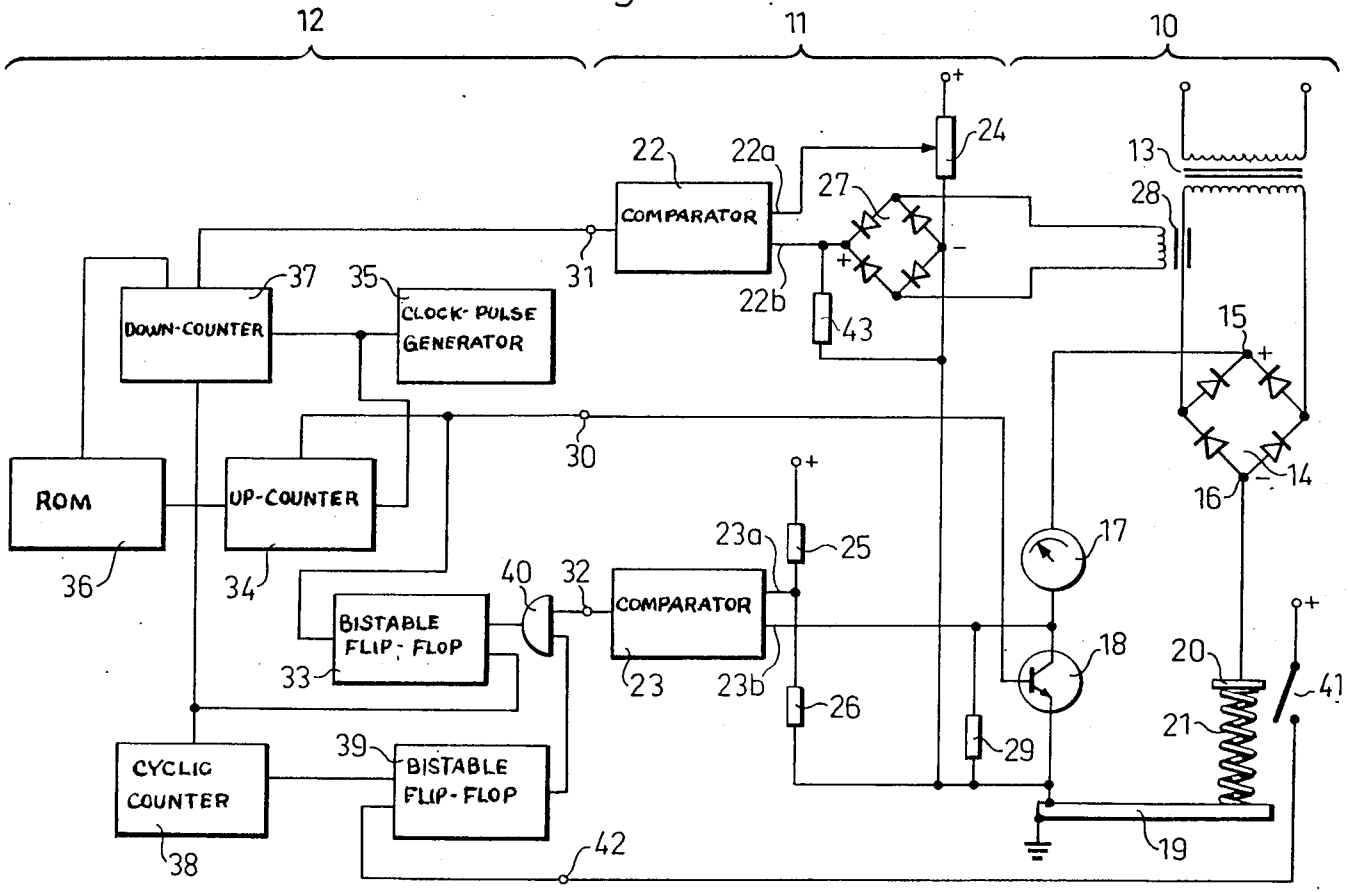

The present invention relates to a method for heat treating coiled springs through subjecting each spring to a separate electrical resistance heating operation.

More particularly, the invention relates to such a method of the kind comprising the steps of placing a spring between two electrodes, with opposite ends of the spring in contact under pressure against said electrodes, feeding a series of electric current pulses through the spring via said electrodes, each of said pulses having the general shape of a portion of a sine half wave, evaluating the amplitude of the sine half wave corresponding to each current pulse, and controlling the total energy supplied to the spring in dependence upon said amplitude evaluation.

In the prior art, all current pulses within said series of current pulses have been of equal length and the total energy supplied to the spring has been controlled by varying the number of current pulses fed to each separate spring. However, in practice, such a manner of controlling the total supply of electric energy to each spring has been found unfavourable as the total time for the heat treatment of the spring will vary from one spring to another within each series of springs to be treated.

The invention has for its object to provide an improved method of the kind initially specified, which makes it possible to maintain the total heat treatment time for each spring at a constant value for all springs belonging to the same series.

In accordance with the invention, for said purpose, there is proposed a method of said kind, primarily characterized by feeding a predetermined constant number of current pulses having low initial values through said spring and varying the length of each current pulse in dependence upon said amplitude evaluation.

By utilizing current pulses having low initial values, i.e. pulses starting close to the beginning of the sine half wave in question, and varying the length of each current pulse in dependence upon the evaluated amplitude of the sine half wave, it is possible to vary the total energy supplied to each spring within wide limits, although the number of current pulses is kept constant for all springs of the same series.

The evaluation of the amplitude of the sine half wave corresponding to each current pulse need not be effected by determining said amplitude itself. Instead, said amplitude evaluation may preferably be effected by determining the rise time of each current pulse from its low initial value to a predetermined higher value. The length of each current pulse may then be varied in dependence upon its said rise time, preferably in dependence upon stored information representing the required current pulse length for different values of said rise time and suitably defining the required continued duration of each current pulse upon the end of said rise time.

The invention also relates to an apparatus for heat treating coiled springs through subjecting each spring to a separate electrical resistance heating operation, said apparatus comprising two electrodes between which a spring may be placed with opposite ends thereof in contact under pressure against said electrodes, an electric current supply unit connected to said electrodes and arranged to feed a series of electric current pulses through the spring via said electrodes, each of said pulses having the general shape of a portion of a sine half wave, an evaluation unit connected to said current supply unit and arranged to evaluate the amplitude of the sine half wave corresponding to each current pulse, and a control unit connected to said current supply unit and said evaluation unit and arranged to control the total energy supplied to the spring from said current supply unit in dependence upon the amplitude evaluation effected by said evaluation unit. The apparatus proposed according to the invention is primarily characterized in that said control unit is arranged to bring the current supply unit to feed a predetermined constant number of current pulses having low initial values through the spring and to control the length of each current pulse in dependence upon the amplitude evaluation effected by said evaluatioin unit.

Figure 2A:
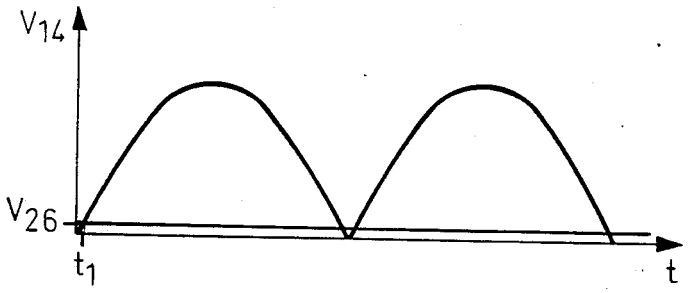
Figure 2B:
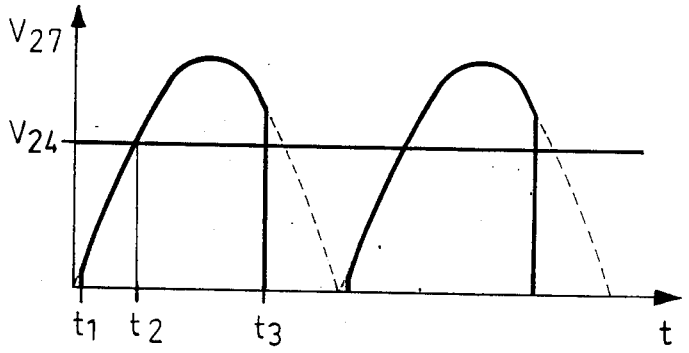

Below the invention will be described in further detail, reference being had to the accompanying diagrammatic drawings, in which:

FIG. 1 shows a block circuit diagram illustrating an apparatus according to an embodiment of the invention, selected by way of example only, while FIGS. 2*a* and 2*b* show two different graphs illustrating two different voltages generated within said apparatus, as functions of time.

The apparatus shown in FIG. 1 comprises an electric current supply unit 10, an evaluation unit 11 and a control unit 12.

Current supply unit 10 contains a transformer 13, the primary winding of which is intended to be connected to a main supplying said winding with an A.C. voltage of for instance 220 volts and 50 cycles per second. The secondary winding of transformer 13 is connected to a fullwave rectifier 14. Across its two output terminals 15 and 16, said rectifier 14 generates a pulsating D.C. voltage $V_{14}$ of the kind illustrated in FIG. 2*a*. From terminals 15 and 16, said voltage $V_{14}$ is supplied to a circuit containing a mean value sensing ammeter 17, a transistor 18 and two electrodes 19 and 20 between which a coiled spring 21 may be placed in the manner illustrated in FIG. 1, with each end thereof in contact under pressure against one of said electrodes.

Spring 21 may preferably be placed between electrodes 19 and 20 by means of an automatically operated revolving spring holder having a plurality of spring receiving chambers which are placed one at a time in consecutive order between said electrodes. Electrode 19 may suitably be stationary mounted, while electrode 20 may be mounted for limited movement in a direction towards and away from electrode 19 to be able to be applied against the upper end of spring 21 so as to compress said spring to a predetermined length. Reference numeral 41 designates a switch adapted to become actuated by movable electrode 20. When unactuated, switch 41 is open. However, as soon as electrode 20 has been applied against spring 21 and compressed the latter to its predetermined length, switch 41 is closed.

Evaluation unit 11 contains two comparators 22 and 23, each of which has a reference voltage input 22*a* and 23*a*, respectively, and a test voltage input 22*b* and 23*b*, respectively. Reference voltage input 22*a* of comparator 22 receives an adjustable D.C. reference voltage from a potentiometer 24, while reference voltage input 23*a* of comparator 23 receives a constant D.C. reference voltage from a voltage divider consisting of two resistors 25 and 26 which are connected in series with each other.

Test voltage input 22*b* of comparator 22 is connected to the output of a full wave rectifier 27 loaded by a resistor 43 and fed from a current transformer 28 which is connected into the supply line between transformer 13 and rectifier 14. Hereby, input 22*b* of comparator 22 will be supplied with a pulsating voltage $V_{27}$ of the kind illustrated in FIG. 2*b*. At each moment, said voltage $V_{27}$ will be proportional to the current passing through spring 21.

Test voltage input 23*b* of comparator 23 is connected to the connection line between ammeter 17 and transistor 18. Reference numeral 29 designates a high ohmic resistance connected in parallel with said transistor. The base of the transistor 18 is connected to a control signal output 30 of control unit 12 which also has two inputs 31 and 32, each connected to the output of one of the two comparators 22 and 23, and an additional input 42 which is connected to switch 41.

Control unit 12 comprises a bistable flip-flop 33 having a set input, connected to input 32 via an AND-gate 40, and an output which is connected to control signal output 30. Control unit 12 also comprises an up-counter 34 having a clock-pulse input, connected to a clock-pulse generator 35, and a control input, connected to the output of flip-flop 33. Said counter 34 serves as an addressing means for a ROM 36 and, for this purpose, it has its output connected to an address input of said memory 36. A data output of memory 36 is connected to a data input of a down-counter 37 having a clock-pulse input, connected to clock-pulse generator 35, a load-pulse input, connected to input 31, and an output which is connected to a reset input of flip-flop 33. The output of down-counter 37 is also connected to an input of a cyclic counter 38, having its output connected to a reset input of a bistable flip-flop 39, the set input of which is connected to input 42. The output of flip-flop 39 is connected to one input of AND-gate 40, the other input of which is connected to control input 32, while the output of gate 40 is connected to the set input of flip-flop 33.

The manner of operation of the apparatus above described will now be explained.

When switch 41 is closed, flip-flop 39 is set and caused to deliver an output signal representing a logic "1" to AND-gate 40. Control unit 12 is then ready to operate under the control of the output signals from comparators 22 and 23 received over inputs 31 and 32.

Flip-flop 33, which until now has been in its reset state, will then shift to its set state as soon as it receives a signal representing a logic "1" from AND-gate 40. This happens when comparator 23 generates a corresponding output signal, which occurs as soon as the output voltage $V_{14}$ from rectifier 14 passes the reference voltage $V_{26}$ appearing across resistor 26 in an ascending direction. In FIG. 2*a*, the corresponding time has been desiganted $t_1$. In this connection it shoud be noted that reference voltage $V_{26}$ has a very low value as compared to the amplitude of voltage $V_{14}$.

At said time $t_1$, counter 34, which has previously been cleared, receives a control signal from flip-flop 33 causing said counter to start counting one step for each clock-pulse supplied from clock-pulse generator 35, which delivers a continuous series of clock pulses having a high frequency as compared to the frequency of the main voltage. Hereby, counter 34 starts addressing successive storage locations in memory 36 causing different values permanently stored in said storage locations to become successively available at the data input of down-counter 37. However, said values will not be loaded into counter 37 until said counter receives a load pulse from comparator 22.

The output signal from flip-flop 33 generated when said flip-flop is set is also fed to the base of transistor 18 which then shifts from a non-conducting to a conducting state. This means that at time $t_1$, rectifier 14 will start feeding a current through spring 21. Since rectifier 27 is fed from transformer 28, this rectifier will simultaneously start delivering a voltage $V_{27}$, proportional to said current, to the test voltage input 22*b* of comparator 22. Said voltage $V_{27}$ will gradually grow according to a sine curve from a low initial value.

When, at the time designated $t_2$ in FIG. 2*b*, voltage $V_{27}$ reaches the reference voltage $V_{24}$ set by means of potentiometer 24, comparator 22 delivers an output signal to down-counter 37 serving as a load pulse for said counter hereby causing the value from memory 36 instantaneously supplied to the data input of counter 37 to become loaded into said counter. Counter 37 then starts counting down from said value to zero under the control of the clock pulses supplied from clock-pulse generator 35.

When, at the time designated $t_3$ in FIG. 2*b*, counter 37 has counted down to zero, it will deliver an output pulse to the reset input of flip-flop 33 hereby resetting said flip-flop. The output signal from flip-flop 33 is now changed so as to bring transistor 18 to shift to its non-conducting state. Simultaneously,counter 34 is cleared. The output pulse generated by counter 37 is also supplied to cyclic counter 38 causing said counter to count one step.

A new cycle, corresponding to the one above described, will then start at time $t_1$ during the next following half period of the output voltage $V_{14}$ from rectifier 14. As can be seen from FIG. 2*a*, said voltage consists of successive sine half waves. At the end of each cycle, counter 38 counts one step. When said counter, which for instance may have a capacity of 50 steps, reaches its last step, it delivers an output signal to the reset input of flip-flop 39 hereby resetting said flip-flop. This will cause the input of AND-gate 40 connected to the output of flip-flop 39 to receive an input signal corresponding to a logic "0" which means that a new cycle cannot be started from comparator 23 unitl flip-flop 39 has again been caused to shift to its set state. However, this does not occur until spring 21 has been replaced by another spring.

The output signal from counter 38 may also be utilized to activate the required means for lifting electrode 20, feeding a new spring 31 into position between the two electrodes 19 and 20 and lowering electrode 20 into contact under pressure against said new spring.

The values stored in memory 36 may advantageously consist of empirically determined values representing the required continued duration of each current pulse fed through spring 21 after the expiration of different rise times of said pulses from the low initial value at time $t_1$ to the predetermined higher value, corresponding to reference voltage $V_{24}$, at time $t_2$.

When shifting from treating one kind of springs to another kind of springs, the apparatus may easily be trimmed to provide an appropriate heating of the new type of springs simply by adjusting potentiometer 24 so as to cause the mean value of the heating current readable on ammeter 17 to assume an appropriate value.

I claim:

1. A method for heat treating coiled springs through subjecting each spring to a separate electrical resistance heating operation, said method comprising the steps of placing a spring between two electrodes, with opposite ends of the spring in contact under pressure against said electrodes, feeding a predetermined constant number of electric current pulses through the spring via said electrodes, each of said pulses having the general shape of a portion of a sine half wave and commencing from a initial preselected value and rising to a predetermined higher value, evaluating the amplitude of the sine half wave corresponding to each current pulse by determining the rise time of each current pulse from its initial preselected value to its predetermined higher value, and controlling the total energy supplied to the spring in dependence upon said amplitude evaluation by varying the length of each current pulse in dependence upon its rise time.

2. A method according to claim 1, characterized by varying the length of each current pulse in dependence upon stored information representing the required current pulse length for different values of said rise time.

3. A method according to claim 2, characterized by varying the length of each current pulse in dependence upon stored information defining the required continued duration of each current pulse upon the end of its said rise time.

4. An apparatus for heat treating coiled springs through subjecting each spring to a separate electrical resistance heating operation, said apparatus comprising two electrodes between which a spring may be placed with opposite ends thereof in contact under pressure against said electrodes, an electric current supply unit connected to said electrodes and arranged to feed a predetermined constant number of electric current pulses through the spring via said electrodes, each of said pulses having the general shape of a portion of a sine half wave and commencing at an initial preselected value and rising to a predetermined higher value, an evaluation unit connected to said current supply unit and arranged to evaluate the amplitude of the sine half wave corresponding to each current pulse by determining the rise time of each current pulse from its initial preselected value to its predetermined higher value, and a control unit connected to said current supply unit and said evaluation unit and arranged to control the total energy supplied to the spring from said current supply unit in dependence upon the amplitude evaluation effected by said evaluation unit by controlling the length of each current pulse in dependence upon its rise time.

5. An apparatus according to claim 4, characterized in that said control unit is arranged to control the length of each current pulse in dependence upon stored information representing the required current pulse length for different values of said rise time.

6. An apparatus according to claim 5, characterized in that said stored information defines the required continued duration of each current pulse upon the end of its said rise time.

* * * * *